US005090693A

United States Patent [19]

Liang

[11] Patent Number: 5,090,693

[45] Date of Patent: Feb. 25, 1992

[54] DUMBBELL

[76] Inventor: Yung-Jen Liang, No. 76, An-Le Str. An-Tung Tsun, Hsiu Shui Hsiang, Chang Hua Hsien, Taiwan

[21] Appl. No.: 707,606

[22] Filed: May 30, 1991

[51] Int. Cl.[5] ..... A63B 21/072

[52] U.S. Cl. ..... 272/122; 272/117

[58] Field of Search ..... 272/67, 68, 117, 119, 272/122, 123, 124, 143

[56] References Cited

U.S. PATENT DOCUMENTS

| | | | |
|---|---|---|---|
| 937,225 | 10/1909 | Burr | 272/122 |
| 1,536,048 | 5/1925 | Plastalo | 272/122 |
| 1,991,520 | 2/1935 | Postl | 272/122 |
| 4,076,236 | 2/1978 | Ionel | 272/123 |
| 4,566,690 | 1/1986 | Schook | 272/123 |
| 4,638,994 | 1/1987 | Gogarty | 272/122 |
| 4,681,315 | 7/1987 | Yang | 272/122 |

FOREIGN PATENT DOCUMENTS

| | | | |
|---|---|---|---|
| 812677 | 5/1937 | France | 272/122 |

*Primary Examiner*—Robert Bahr

*Attorney, Agent, or Firm*—Bacon & Thomas

[57] ABSTRACT

A dumbbell comprising a handlebar having two joints at two opposite ends for mounting a plurality of pairs of weights, wherein said joints have each an inner thread and an outer thread; said weights include a pair of first weights, a pair of cover weights and at least one pair of auxiliary weights. Each first weight has a stepped bolt hole through the central axis thereof which includes a first bolt hole at one end and a second bolt hole at an opposite end respectively made in size equal to the outer thread and the inner thread on each joint. Each auxiliary weight has a screw rod at one end in outer diameter equal to the inner thread on each joint and a bolt hole at an opposite end in inner diameter equal to the inner thread on each joint. Each cover weight has a screw rod at one end in size equal to the screw rod on each auxiliary weight. By connecting the first weights, the auxiliary weights or the cover weights to the handlebar, the dumbbell is arranged into any of a variety of forms.

2 Claims, 3 Drawing Sheets

DUMBBELL

BACKGROUND OF THE INVENTION

The present invention relates to dumbbells and relates more particularly to a built-up dumbbell which can be conveniently alternatively set into a any of a variety of forms to suit individual physical strength.

Dumbbell is a device very convenient and practical for muscular exercise. Because it does not occupy much space and is inexpensive, it is widely accepted by the people of all ages who like to exercise the muscles. According to conventional structure, a dumbbell is generally made of iron in a solid unit through casting process, having two unitary, round weights joined by a short bar. Because it is made in a solid unit, it makes transportation and packing difficult. It is too simple in structure to sell at a profit-yield price and therefore, few distributors would like to promote the selling. Further, it can not be adjusted in weight to meet individual requirement or physical condition.

To eliminate the aforesaid problems, there is disclosed an adjustable dumbbell. This structure of adjustable dumbbell, as shown in FIG. 6, is generally comprised of a handlebar and a plurality of pairs of weights which are made according to the same specification. The weights are attached to the handlebar through screw joint by O-rings, rubber caps and lock nuts. This structure of adjustable dumbbell is still not satisfactory in use because of the following disadavantages.

1. It is difficult to mount or dismount the weights;
2. The fastening accessories may be damaged easily to affect the performance of the dumbbell; and
3. Because the weights are made according to the same specification, it can not be arranged into a variety of forms to meet every individual's physical strength.

SUMMARY OF THE INVENTION

The present invention has been accomplished to eliminate the aforesaid problems. It is therefore an object of the present invention to provide a built-up dumbbell which can be conveniently alternatively arranged into any of a variety of forms to suit individual physical strength.

It is another object of the present invention to provide a built-up dumbbell which has a handlebar, by which it is lifted or swung about in the hand for muscular exercise, made in structure for comfortable and positive grip.

It is still another object of the present invention to provide a built-up dumbbell which is simple in structure and durable in use.

It is still another object of the present invention to provide a built-up dumbbell which is suitable for mass production to greatly reduce the cost.

BRIEF DESCRIPTION OF THE DRAWINGS

FIG. 1 is a dismantled perspective view of the present invention;

FIG. 1-1 is a sectional side view showing the structure of the main weight;

FIG. 1-2 is a sectional side view showing the structure of the auxiliary weight;

FIG. 1-3 is a sectional side view showing the structure of the cover weight;

FIGS. 2, 3, 4 and 5 illustrate that the present invention can be arranged into any of a variety of forms.

DETAILED DESCRIPTION OF THE PREFERRED EMBODIMENT

Figures 1, 2, 3:
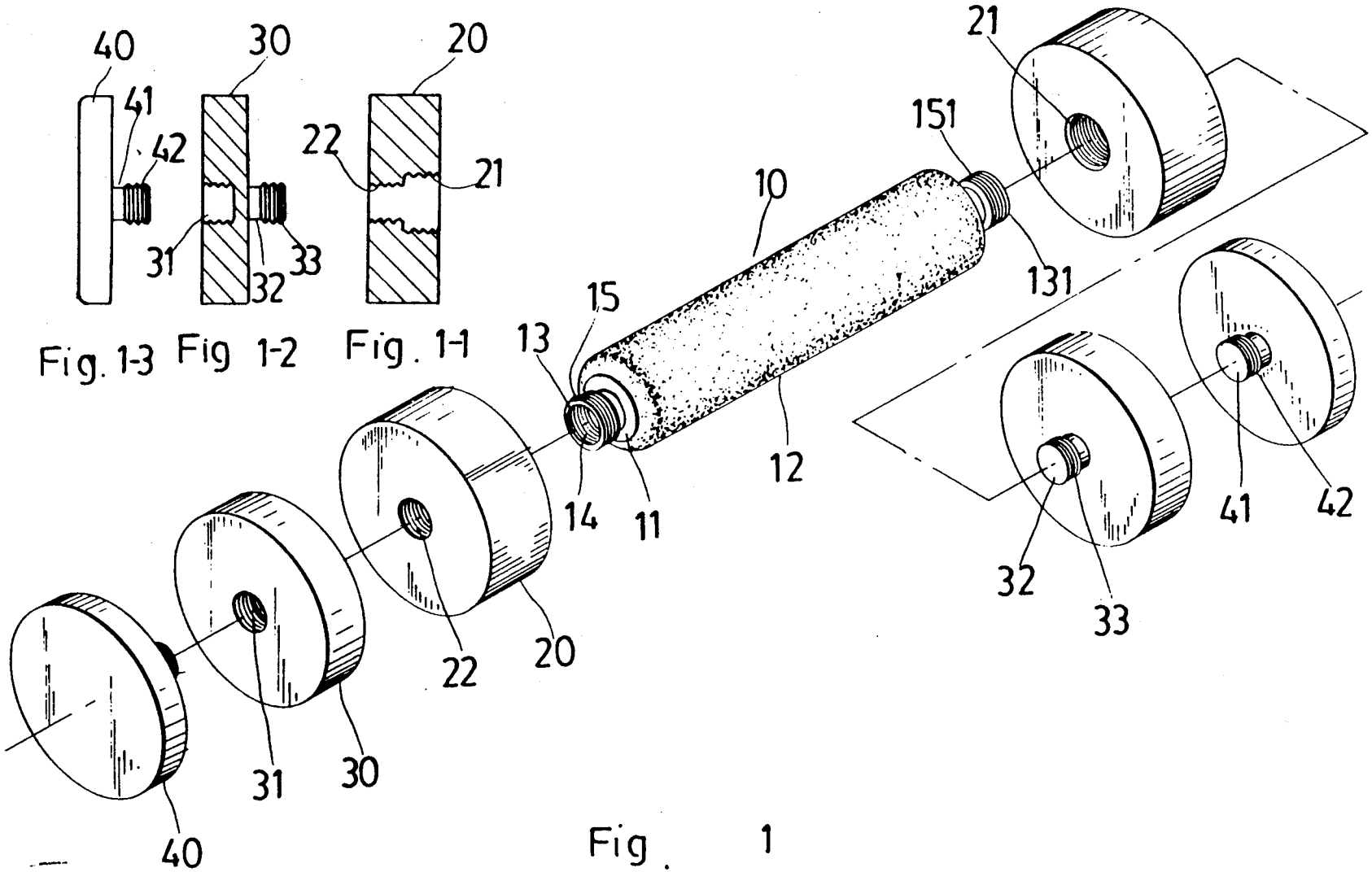
Figure 3:
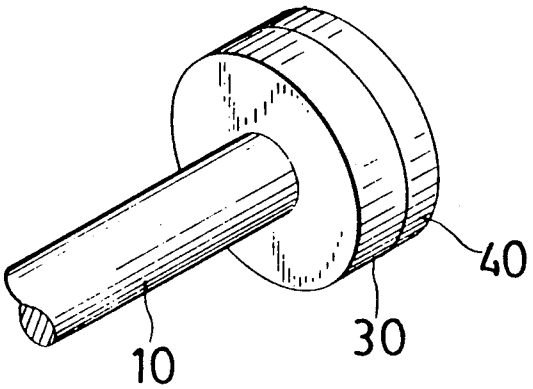

Referring to FIG. 1, a dumbbell in accordance with the present invention is generally comprised of a handlebar 10, a pair of main weights 20, a pair of cover weights 40 and at least a pair of auxiliary weights 30. The handlebar 10 by which the dumbbell is lifted or swung about in the had for muscular exercise is comprised of a metal rod 11 covered with a layer of soft covering 12, which metal rod 11 has two joints 13 and 131 formed at the two opposite ends thereof and respectively extended out of the said layer of soft covering 12 at two opposite ends, which joints 13 and 131 have each an inner thread 14 or 141 (not shown) and an outer thread 15 or 151. Each main weight 20, as shown in FIG. 1-1, has a stepped bolt hole at the center, namely, a front bolt hole 21 at one end and a back bolt hole 22 longitudinally aligned at an opposite end, wherein the front bolt hole 21 has an inner diameter larger than the back bolt hole 22 and suitable for fastening the outer thread 15 or 151 on the joint 13 or 131. Each auxiliary weight 30, as shown in FIG. 1-2, has a screw rod 32 vertically disposed at the center at one side in concentric with the central axis thereof which has an outer thread 33 made in size suitable for fastening in the back bolt hole 22 on the main weight 20, and a bolt hole 31 longitudinally disposed at an opposite side in alignment with said screw rod 32 and in size equal to the back bolt hole 22 on each main weight 20 and the inner thread 14 or 141 on the joint 13 or 131. Each cover weight 40, as shown in FIG. 1-3, has a screw rod 41 vertically disposed at one side in concentric with the central axis thereof, which screw rod 41 has an outer thread 42 made in size equal to the screw rod 32 on each auxiliary weight 30.

Figure 5:
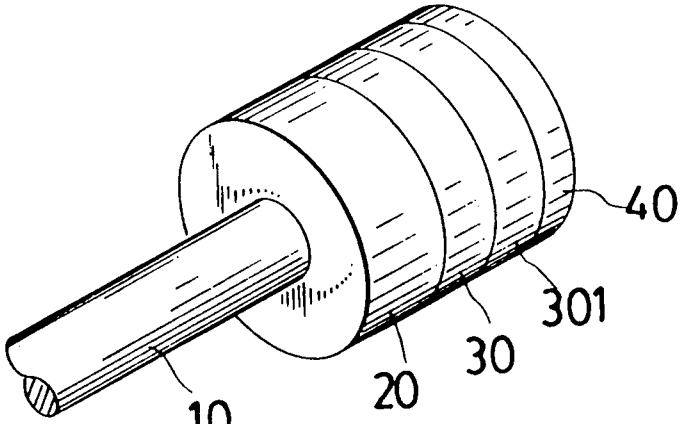
Figure 2:
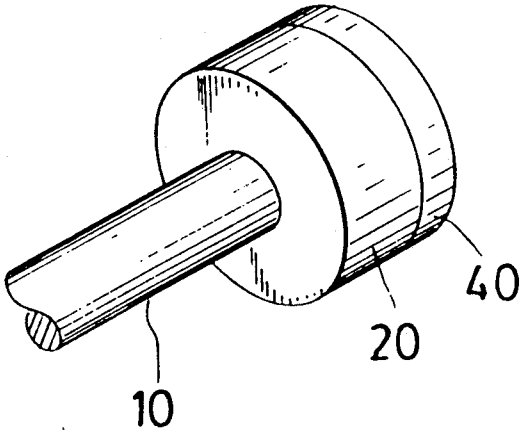
Figure 4:
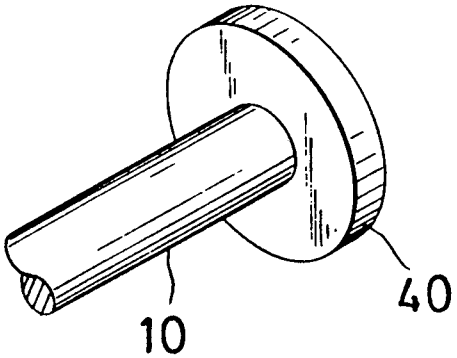
Figure 6:
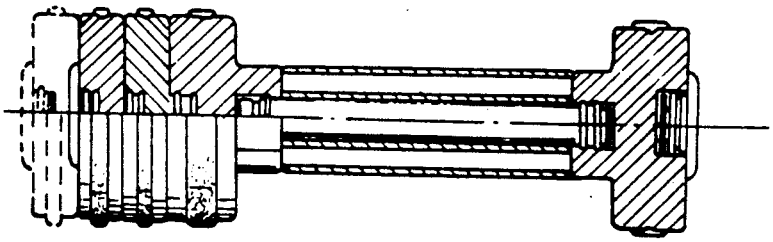
Fig. 6 PRIOR ART
FIG. 6 is a sectional side view of the prior art.

The aforesaid handlebar 10 and weights 20, 30 and 40 can be alternatively joined into a variety of forms. In the arrangement of FIG. 1, one pair of auxiliary weights 30 are respectively connected between the pair of main weights 20, which are respectively connected to the two joints 13 and 131 of the handlebar 10 through screw joint, and the pair of cover weights 40. In the arrangement of FIG. 2, the pair of cover weights 40 are directly respectively attached to the pair of main weights 20 which are respectively secured to the two joints 13 and 131 of the handlebar 10. In the arrangement of FIG. 3, the pair of cover weights 40 are respectively attached to the pair of auxiliary weights 30 which are directly connected to the two joints 13 and 131 of the handlebar 10. In the arrangement of FIG. 4, the pair of cover weights are directly attached to the two joints 13 and 131 of the handlebar 10. There is still another alternate arrangement shown in FIG. 5, wherein two pairs of auxiliary weights 30 and 301 are respectively connected together and joined between the pair of main weights 20 and the pair of cover weights 40.

As indicated, the present invention is to provide a built-up dumbbell which can be conveniently alternatively arranged into any of a variety of forms according to personal physical requirement.

I claim:

1. A dumbbell for muscular exercise, the improvement comprising:

a handlebar comprising a metal rod covered with a layer of soft covering for positive and comfortable grip, said metal rod having two joints formed at two opposite ends and respectively extended out of said soft covering. said two joints having each an inner thread and an outer thread;

a pair of first weights having each a threaded stepped bolt hole through the central axis thereof, said threaded stepped bolt hole including a first bolt hole at one end and a second bolt hole longitudinally aligned at an opposite end, said first bolt hole having a inner diameter equal to the outer diameter on said joints, said second bolt hole having an inner diameter equal to the inner diameter on said joints;

at least one pair of auxiliary weights having each a screw rod at one end longitudinally aligned with the central axis thereof and alternatively fastened in the second bolt hole on either of said first weights or the inner thread on either of said two joints, and a bolt hole disposed at an opposite end longitudinally aligned with the central axis thereof and made in size equal to said second bolt hole on either of said first weights and the inner thread on either of said joints; and a pair of cover weights having each a screw rod at one end longitudinally aligned with the central axis thereof and alternatively fastened in the bolt hole on either of said auxiliary weights, the second bolt hole on either of said first weights or the inner thread on either of said joints.

2. The dumbbell according to claim 1, wherein said pair of first weights, said at least one pair of auxiliary weights or said pair of cover weights can be alternatively directly connected to said two joints and, said pair of cover weights can be alternatively directly connected to said pair of first weights or said at least one pair of auxiliary weights.

* * * * *